US008322893B2

(12) United States Patent
Nezu

(10) Patent No.: US 8,322,893 B2
(45) Date of Patent: Dec. 4, 2012

(54) ILLUMINATION DEVICE

(75) Inventor: Kenji Nezu, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 488 days.

(21) Appl. No.: 12/615,753

(22) Filed: Nov. 10, 2009

(65) Prior Publication Data

US 2010/0118548 A1 May 13, 2010

(30) Foreign Application Priority Data

Nov. 12, 2008 (JP) ..... 2008-289966

(51) Int. Cl.
*F21V 7/00* (2006.01)

(52) U.S. Cl. ..... 362/297; 362/241; 362/249.02; 362/247; 362/346

(58) Field of Classification Search ..... 362/235, 362/297, 249.02, 249.03–249.06, 362, 368, 362/241, 243, 245, 247, 346, 347, 327, 328
See application file for complete search history.

(56) References Cited

U.S. PATENT DOCUMENTS

| | | | | |
|---|---|---|---|---|
| 2,332,138 | A * | 10/1943 | Epstein | 362/223 |
| 7,414,546 | B2 | 8/2008 | Singer | |
| 7,434,959 | B1 * | 10/2008 | Wang | 362/249.01 |
| 7,506,997 | B1 | 3/2009 | Eriksson | |
| 2003/0117798 | A1 | 6/2003 | Leysath | |
| 2003/0156416 | A1 | 8/2003 | Stopa | |
| 2005/0030752 | A1 | 2/2005 | Imai | |
| 2007/0121343 | A1 | 5/2007 | Brown | |
| 2007/0247856 | A1 | 10/2007 | Wang | |
| 2008/0062689 | A1 | 3/2008 | Villard | |
| 2008/0123367 | A1 | 5/2008 | Pan | |

(Continued)

FOREIGN PATENT DOCUMENTS

CN 2842187 Y 11/2006

(Continued)

OTHER PUBLICATIONS

English Language Abstract of JP 2000-200102, published Jul. 18, 2000.

(Continued)

*Primary Examiner* — Bao Q Truong
(74) *Attorney, Agent, or Firm* — DLA Piper LLP (US)

(57) ABSTRACT

An illumination device is provided with: a light source part 40 having an LED 20 of a light source and a reflector 30 including a first reflection surface 33 which has a concavely curved cross section from one end to the other end and is formed so as to dispose the light source within this curved cross section and a second reflection surface 32 closing the curved cross section on the one end side; and a device main body 10 including a top panel 11, an attachment part which is provided on a lower surface side of the top panel 11 and attaches the light source part 40 so as to make one end of the light source part 40 be positioned on the top plate 11 side, and a side wall part 12 which is disposed downward from the top panel 11 and has a lower end edge part 12*a* provided below a straight line extending from the other end side of the LED 20 being the light source through a top end of the second reflection surface 32.

5 Claims, 6 Drawing Sheets

U.S. PATENT DOCUMENTS

| | | | | |
|---|---|---|---|---|
| 2008/0186695 | A1 | 8/2008 | Awai | |
| 2010/0053953 | A1 * | 3/2010 | Wung et al. | 362/235 |
| 2010/0142201 | A1 | 6/2010 | Venturini | |
| 2010/0214780 | A1 | 8/2010 | Villard | |
| 2010/0296289 | A1 | 11/2010 | Villard | |

FOREIGN PATENT DOCUMENTS

| | | | |
|---|---|---|---|
| CN | 101101096 | A | 1/2008 |
| CN | 101101102 | A | 1/2008 |
| DE | 202007001148 | | 3/2007 |
| GB | 487122 | | 6/1938 |
| JP | 2000-200102 | | 7/2000 |
| JP | 2003-203506 | | 7/2003 |
| JP | 2004-200102 | | 7/2004 |
| JP | 3694310 | | 6/2006 |
| JP | 2007-165051 | | 6/2007 |
| JP | 2007-242258 | | 9/2007 |
| JP | 3137249 | | 10/2007 |
| JP | 2009-290244 | | 12/2009 |
| WO | WO 2007/088665 | | 8/2007 |

OTHER PUBLICATIONS

Machine English Language Translation of JP 2000-200102, published Jul. 18, 2000.

English Language Abstract of JP 2004-200102, published Jul. 15, 2004.

Machine English Language Translation of JP 2004-200102, published Jul. 15, 2004.

Office Action issued in corresponding application CN 200910146546.8 on Jun. 23, 2010.

English Translation of Office Action issued in corresponding application CN 200910146546.8 on Jun. 23, 2010.

English Language Abstract of CN 101101096A published Jan. 9, 2008.

English Language Abstract of CN 2842187Y, published Nov. 29, 2006.

English Language Abstract of CN 101101102A, published Jan. 9, 2008.

European Search Report issued in EP 09014067.4 dated Mar. 16, 2010.

English Language Abstract of JP 2007-242258 published Sep. 20, 2007.

English Language Translation of JP 2007-242258 published Sep. 20, 2007.

U.S. Appl. No. 13/169,814.

English Language Abstract of JP 2009-290244 published Dec. 10, 2009.

English Language Translation of JP 2009-290244 published Dec. 10, 2009.

English Language Abstract of JP 2003-203506 published Jul. 18, 2003.

English Language Translation of JP 2003-203506 published Jul. 18, 2003.

English Language Abstract of JP 2007-165051 Published Jun. 28, 2007.

English Language Translation of JP 2007-165051 Published Jun. 28, 2007.

English Language Abstract of JP 2006-156192 Published Jun. 15, 2006.

English Language Translation of JP 2006-156192 Published Jun. 15, 2006.

English Language Abstract of JP 3137249 Published Oct. 24, 2007.

English Language Translation of JP 3137249 Published Oct. 24, 2007.

U.S. Appl. No. 12/473,482.

European Search Report issued in EP 09007244 on Sep. 22, 2011.

U.S. Appl. No. 13/045,831.

U.S. Appl. No. 13/045,812.

* cited by examiner

ILLUMINATION DEVICE

TECHNICAL FIELD

This invention relates to an illumination device used for a street light and the like.

BACKGROUND ART

As this kind of illumination device in the past, there is known one that includes many substrates each mounting a number of white light emission diodes and employs a configuration arranging these many substrates by changing the angles thereof so as to form polygonal planes to emit light in many directions (refer to Patent document 1).

In this illumination device, however, the light is emitted in the upper direction of a main body part. Particularly for a street light and the like, there is a problem that the above light emitted in the upper direction increases the glare to cause light pollution when the device is viewed from above and the light in the upper direction does not contribute to the illumination on a plane to be illuminated to deteriorate illumination efficiency.

CITATION LIST

Patent Literature

PTL1: Japanese Patent Application KOKAI Publication No. 2004-200102.

SUMMARY OF THE INVENTION

Technical Problem

The present invention has been achieved in order to solve the problem of the illumination device in the past as described above, and an object thereof is to provide an illumination device which can suppress the light emitted in the upper direction of the device to prevent the light pollution in the upper direction of the device and appropriately illuminate a part required to be illuminated such as a road surface.

Solution to Problem

An illumination device according to the present invention is characterized by including: a light source part having a light source and a reflector including a first reflection surface which has a concavely curved cross section from one end to the other end and is formed so as to dispose the light source within this curved cross section and a second reflection surface closing the curved cross section on the one end side; and a device main body including a top panel, an attachment part which is provided on a lower surface side of the top panel and attaches the light source part so as to make one end of the light source part be positioned on the top plate side, and a side wall part which is disposed downward from the top panel and has a lower end edge part provided below a straight line extending from the light source positioned on the other end side of the light source part through a top end of the second reflection surface.

For the light source, it is possible to use an LED, organic EL, a discharge lamp, or the like. The device main body is made of aluminum, a steel plate, or the like which does not transmit light. The side plate part can be integrally provided so as to be hung down from a peripheral side edge part of the top plate, for example, or can be provided separately from the top plate.

The illumination device according to the present invention is characterized in that the lower end edge part of the side wall part is provided so as to be disposed above a height approximately the same as that of the top end of the second reflection surface.

The illumination device according to the present invention is characterized in that a reflection surface is formed at the lower end edge part of the side wall part for reflecting light emitted from the light source of the light source part in a lower direction than an approximately horizontal direction.

The illumination device according to the present invention is characterized in that the light source part is attached to the top plate at a slant so that the first reflection surface faces downward and has an end plate part which is provided on a lower surface side of the top plate and formed so that a lower end edge part thereof is disposed below a height approximately the same as that of the highest end of a side edge part of the other end of the first reflection surface. Here, the end plate part can be configured integrally with the top plate, for example, or can be configured separately.

The illumination device according to the present invention is characterized in that the end plate part is provided so that the lower end edge part thereof is disposed above a height approximately the same as that of the lowest end of the side edge part of the other end of the first reflection surface.

Advantageous Effects of Invention

The present invention can block the light emitted from the light source part in the upper direction of the device by the side wall part and thereby prevent the glare when the device is viewed from above. Further, the side wall part increases a heat dissipation area and thereby can dissipate heat generated in the light source part.

The present invention does not block the light emitted from the light source part in a lower direction than the side direction, and thereby can prevent the glare when the device is viewed from above while keeping distribution of the light which is light-distribution-controlled by the light source part and also improve the illumination efficiency on a plane to be illuminated.

The present invention forms the reflection surface, which reflects the light emitted from the light source of the light source part in a lower direction than the approximately horizontal direction, at the lower end edge part of the side wall part, and thereby reflects the light emitted from the light source by the reflection surface formed at the lower end edge part of the side wall part in a lower direction than the approximately horizontal direction to improve the illumination efficiency on a plane to be illuminated.

The present invention blocks the light emitted from the other end of the first reflection surface in the upper direction of the device when the light source part is attached to the device main body at a slant and can prevent the glare when the device is viewed from above.

The present invention does not block the light emitted from the other end side of the first reflection surface in a lower direction than the side direction of the device when the light source part is attached to the device main body at a slant, and thereby can prevent the glare when the device is viewed from above while keeping distribution of the light which is light-distribution-controlled by the light source part and also improve the illumination efficiency on a plane to be illuminated.

BRIEF DESCRIPTION OF DRAWINGS

FIG. 5(*b*) is a fragmentary cross-sectional view in a side direction showing a second embodiment of the illumination device according to the present invention.

DESCRIPTION OF EMBODIMENTS

Figure 2:
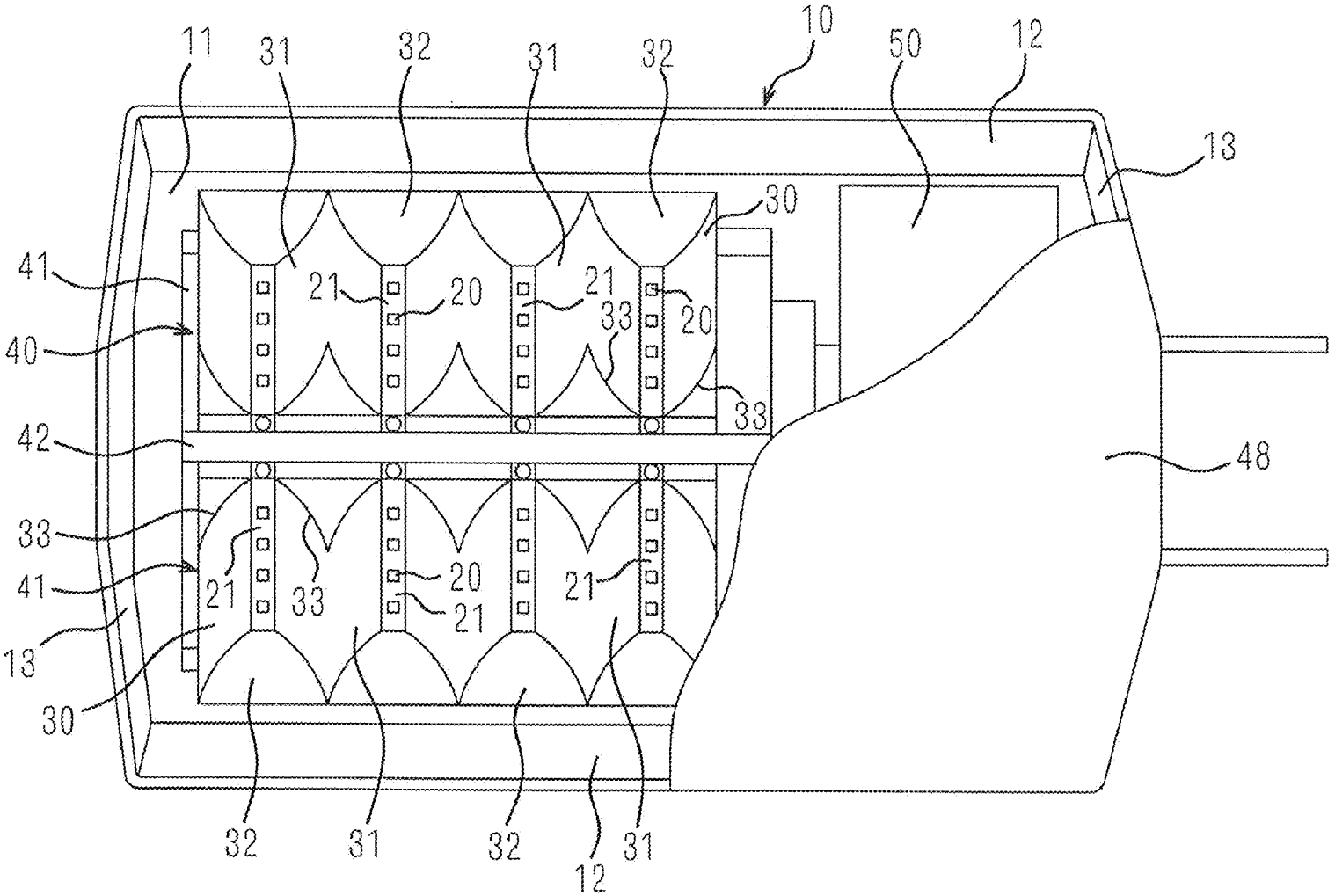
FIG. 2 is a partially broken plan view showing a first embodiment of the illumination device according to the present invention.

Hereinafter, embodiments of an illumination device according to the present invention will be described with reference to the attached drawings. In each of the drawings, the same constituent is denoted by the same reference numeral and repeated description thereof will be omitted. In an illumination device according to a first embodiment of the present invention, as shown in FIG. 2, a device main body 10 includes a top plate 11 having an approximately rectangular shape, and a side wall part 12 which is provided approximately vertically in a downward direction from a peripheral side edge part on each side of a pair of long sides of the top plate 11. In addition, at a peripheral side edge part on each side of a pair of short sides of the top plate 11, an end plate 13 is provided approximately vertically in a downward direction.

The light source part 40 includes a plurality of LEDs 20 as a light source mounted in a line on a substrate 21 and a reflector 30. The reflector 30 has a first reflection surface 33 and a second reflection surface 32, and the first reflection surface 33 has a concavely curved cross section from one end to the other end and formed in a water-shoot shape, for example. The plurality of LEDs are disposed in a reflection chamber 31 which is a water-shoot shaped space formed by this first reflection surface 33. Then, the second reflection surface 32 closes the concavely curved cross section on one end side, that is, closes an opening of the reflection chamber 31 on one end side, and thereby the first and second reflection surfaces 33 and 32 are formed continuously.

The reflector 30 is formed in a rectangular-solid shape which has openings at positions facing the first and second reflection surfaces 33 and 32, respectively, and the openings work as exits of the light emitted from the plurality of LEDs 20 of the light source or the reflected light reflected by these reflection surfaces. A substrate 21 is disposed at the bottom of the reflector 30 and also the first reflection surface 33 is provided with an opening cut for disposing the plurality of LEDs 20. That is, the substrate 21 mounting the plurality of LEDs 20 is attached to the bottom of the reflector 30 from the outer peripheral surface side, and thereby the plurality of LEDs 20 are disposed in the opening cut of the first reflection surface 33.

The first and second reflection surfaces 33 and 32 are formed so as to have mirror surfaces, for example, and this improves the efficiency of taking out the light emitted from the light source and also provides an advantage of preventing the glare because the image of the light source is formed on the first reflection surface 33 and the apparent area of the light source is increased when the light source is viewed toward the first reflection surface 33.

A plurality of the light source parts 40 configured in this manner is disposed in parallel on the surfaces of an attachment part 41, which is disposed on the lower surface side of the top plate 11 and made of an folded aluminum plate having a V-shaped cross section or the like, and the light source part 40 is attached in a manner such that the first reflection surface 33 faces downward and also attached to the surface of the attachment part 41 so as to be inclined against the top plate 11. In addition to this configuration, the light source part 40 is attached in a manner such that one end thereof is disposed on the side of the top plate 11 and the first reflection surfaces 33 of the neighboring light source parts 40 have the edge parts closely contacting each other.

In the attachment part 41, a ridge part 42 is located at the most highly protruded position and the ridge part 42 comes closest to a cover 48 made of translucent plastic. In the device main body 10, a lighting device 50 is provided in a position except the area mounting the light source part 40 and performs the lighting control of the LED 20. An engaging part 48*a* is formed in a peripheral edge end part of the cover 48 surrounding the opening thereof and an engaging part 14 is also formed in the lower end parts of the side wall 12 and the end plate part 13 of the device main body 10, and these engaging part 48*a* and engaging part 14 are engaged with each other to attach the cover 48 to the device main body 10.

Figure 1:
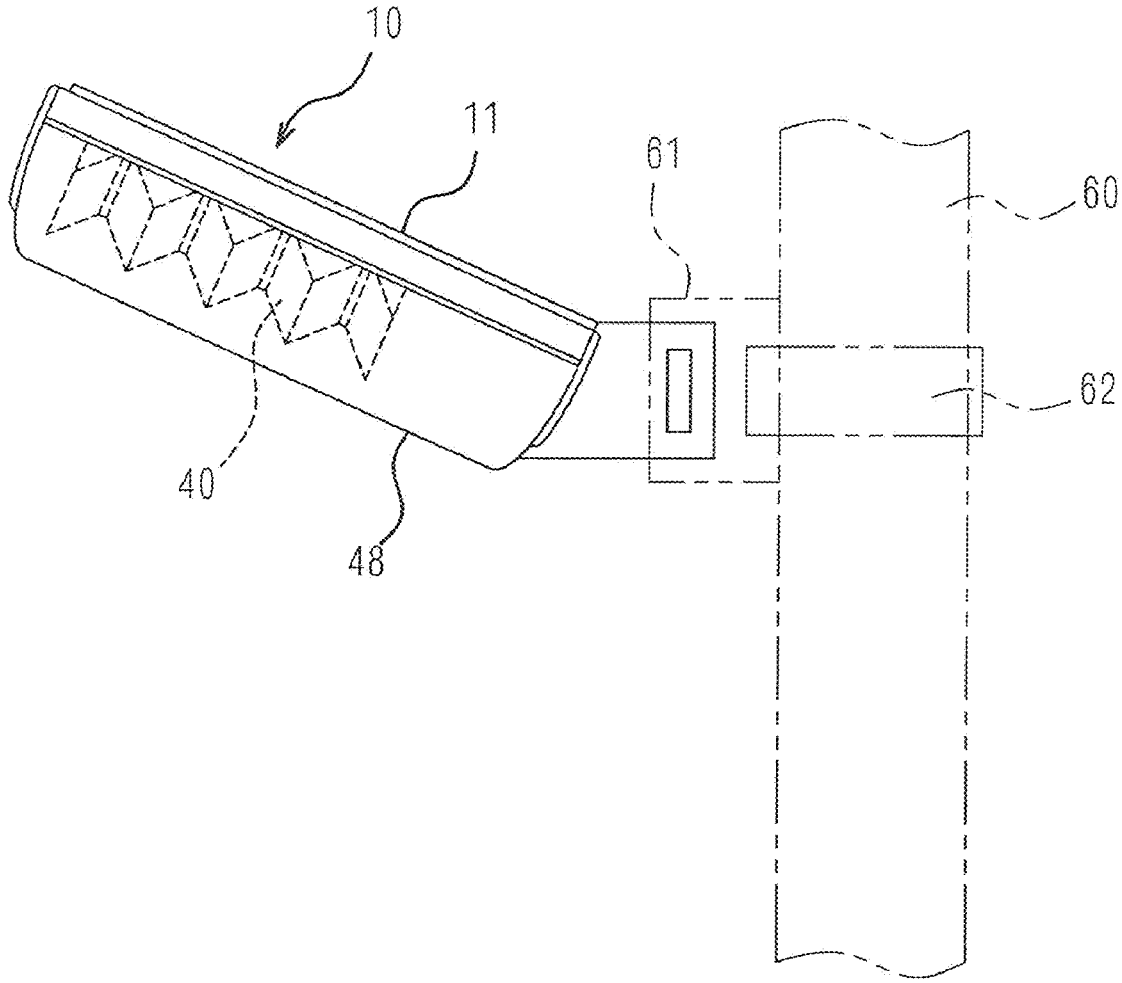
FIG. 1 is a side view showing a use state of an illumination device according to the present invention.

The device main body 10 supporting the attachment part 41 which fixes the plurality of light source parts 40 as described above is supported and fixed in a predetermined position of a power pole 60 erected at a road side, for example, using a support member 61 and a attachment band 62 as shown in FIG. 1. Here, the device main body 10 is fixed obliquely upward at a slant against the axis line of the power pole 60, that is, a vertical line so as to become higher as being apart from the power pole 60.

Figure 3:
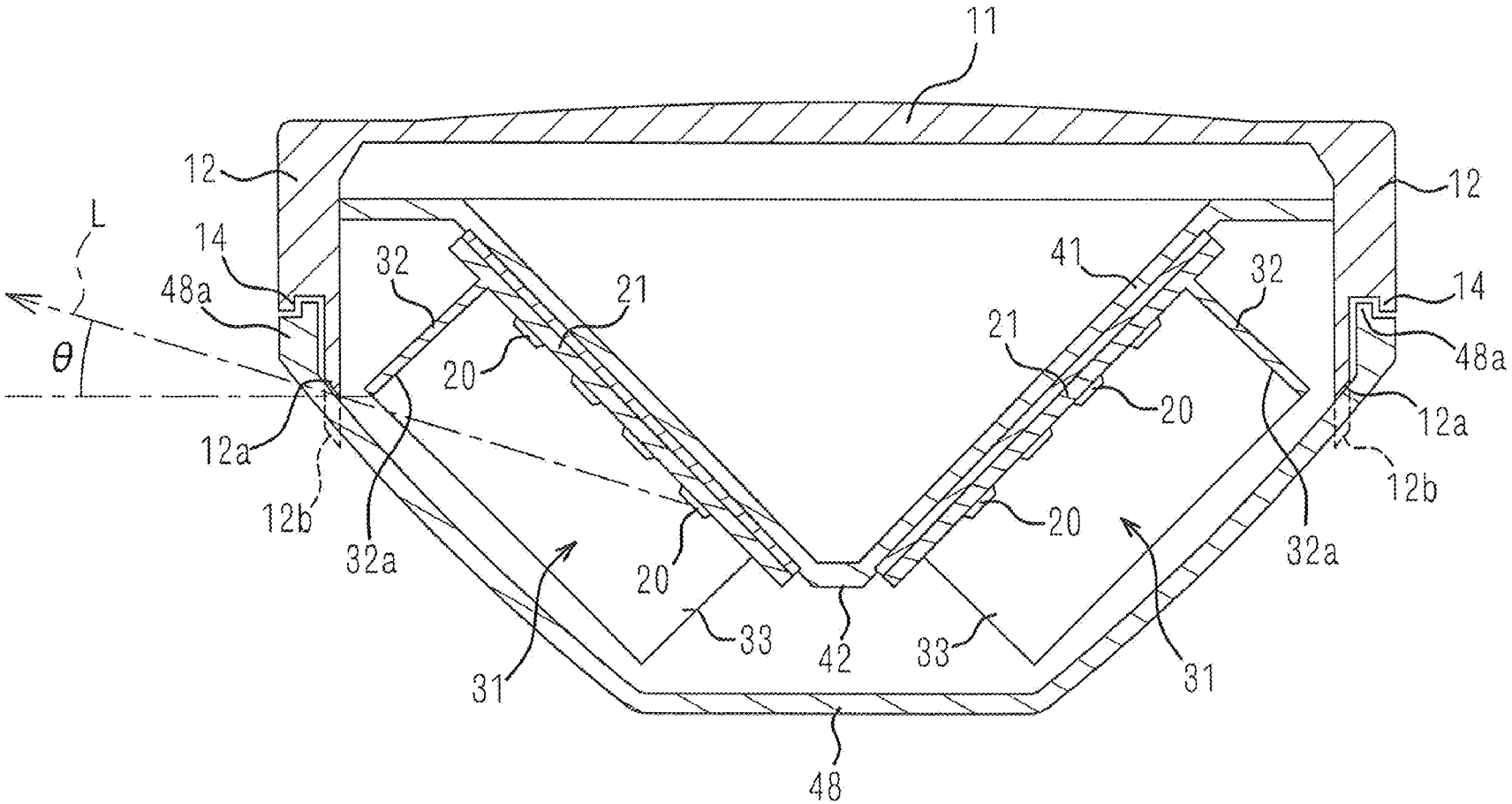
FIG. 3 is a cross-sectional view in a side direction showing the first embodiment of the illumination device according to the present invention.

A lower end edge part 12*a* of the side wall part 12 in the device main body 10 is formed at a height approximately the same as that of a top end 32*a* of the above second reflection surface 32. The light source part 40 is attached to the attachment part 41 so that one end of the light source part 40 provided on the lower surface side of the top plate 11 is disposed on the top plate 11 side, the side wall part 12 is disposed downward from the top plate 11, and the lower end edge part 12*a* is provided below a straight line extending from the LED 20 of the light source located on the other end side of the light source part 40 through the top end 32*a* of the second reflection surface 32. That is, in a cross-sectional view in a plane parallel to the end surface as shown in FIG. 3, the illumination device is configured so as to block the light in the upper direction of a light ray glancing off the lower end edge part 12*a* from the LED 20 mounted at the lowest position which is located at the lowest end side of the plurality of LEDs mounted on the substrate 21, by reflecting the light by an internal surface thereof. Thereby, light illumination is suppressed in the upper direction of the device and it is possible to prevent the glare.

Further, since the light reflected by the internal surface of the side wall part 12 becomes the illumination light directing downward toward a side of a plane to be illuminated, it is possible to efficiently use the light directing in the upper direction of the device which originally does not contribute to the illumination of the plane to be illuminated and to improve the illumination efficiency of the device. Here, in a case in which the light distribution of the light source part 40 is designed according to an object to be illuminated, it is possible to suppress the glare by blocking the light illumination in the upper direction without changing the light distribution of the light source part 40.

On the other hand, a part of the light emitted from the LED 20 in a side direction is reflected downward by the second reflection surface 32 and also, in the lower side of the top end 32*a* of the second reflection surface, the light is radiated in the side direction without being reflected. Here, since the lower end edge part 12*a* of the side wall part 12 is formed so as to be located at a height approximately the same as that of the top end 32*a* of the second reflection surface 32, the light emitted from the LED 20 in the side direction is not blocked and the illumination efficiency of the device is not deteriorated.

Compared to the above, a modification of the first embodiment of an illumination device according to the present invention has a configuration in which a lower end edge part 12*b*, as shown by the chain lines in FIG. 3, is extended from the lower end edge part 12*a* of the side wall part 12 shown by the solid lines. That is, the lower end edge part 12*b* of the side wall part 12, which is provided approximately vertically at each of the pair of peripheral side edge parts of the top plate 11, is formed at a lower position than that of the above top end 32*a* of the second reflection surface 32.

The configuration of the above modification can block the emitted light having an elevation angle θ further smaller than that of a light ray L by the internal surface of the side wall part 12 and prevent the light emission in an unnecessary direction.

Figure 4:
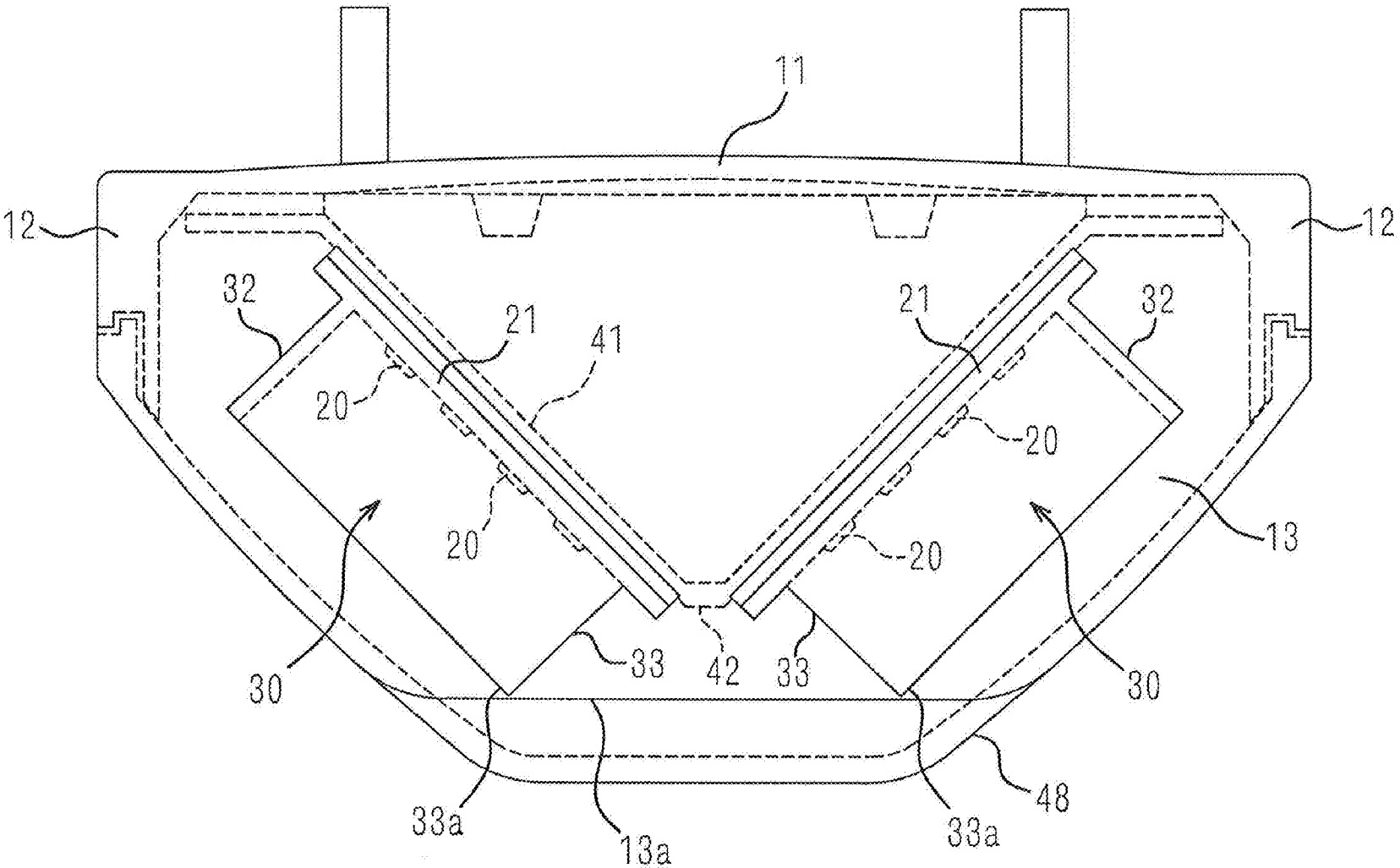
FIG. 4 is a transparent view in a side direction showing the first embodiment of the illumination device according to the present invention.

FIG. 4 is a transparent view of the device main body 10 of the illumination device according to the first embodiment of the present invention when viewed from the end plate part 13 side. In this embodiment, the lower end edge part 13*a* of the end plate part 13, which is provided approximately vertically at each of the pair of peripheral side edge parts of the top plate 11, is formed at a height approximately the same as that of the lowest end 33*a* of the first reflection surface 33 which is the lowest end part of the peripheral edge part of the other end side of the first reflection surface 33 in the reflector 30.

In this configuration, the light emitted from the LED 20 is reflected in various directions by the reflection surfaces within the reflection chamber 31 and includes the light traveling to the above end plate part 13. In all light, the light emitted from the neighborhood of the lowest end 33*a* of the first reflection surface 33, which is the lowest end part of the reflector 30, has a light path closest to the horizontal line to such an extent that the light travelling in this path close to the horizontal line glances off the lowest end 33*a*. That is, the emitted light is blocked by the internal surface of the end plate part 13 so that the light emission in the upper direction can be prevented. Accordingly, since it is necessary to set the height relationship between the lower end edge part 13*a* of the end plate part 13 which is provided approximately vertically at each of the pair of peripheral side edge parts of the top plate 11 so as to almost block the emitted light by the internal surface of the end plate part 13 and the lowest end 33*a* of the first reflection surface 33 which is the lowest end part of the peripheral edge part of the other end side of the first reflection surface 33 in the reflector 30, the end plate part 13 can be provided so that the lower end edge part 13*a* is positioned above a height approximately the same as that of the lowest end 33*a* of the peripheral edge part of the other end side of the first reflection surface 33.

In addition, the present embodiment has the side wall part 12 provided approximately vertically at the peripheral side edge part on each side of the pair of long sides of the top plate 11, and further the end plate part 13 is provided approximately vertically at the peripheral side edge part on each side of the pair of short sides of the top plate 11. That is, the side wall part 12 and the end plate part 13 provided around the top plate 11 are arranged approximately vertically.

Meanwhile, the substrate 21 mounting the LED 20 is attached to the attachment part 41 and heat generated by the LED 20 is conducted through the substrate 21 and the attachment part 41 to the device main body 10. In this case, heat dissipation is carried out efficiently in the configuration in which the side wall part 12 and the end plate part 13 are provided approximately vertically compared to a configuration in which the side wall part 12 and the end plate part 13 are provided at a flat or at a slant, and it is possible to provide an illumination device having a good heat dissipation effect.

Figure 5:
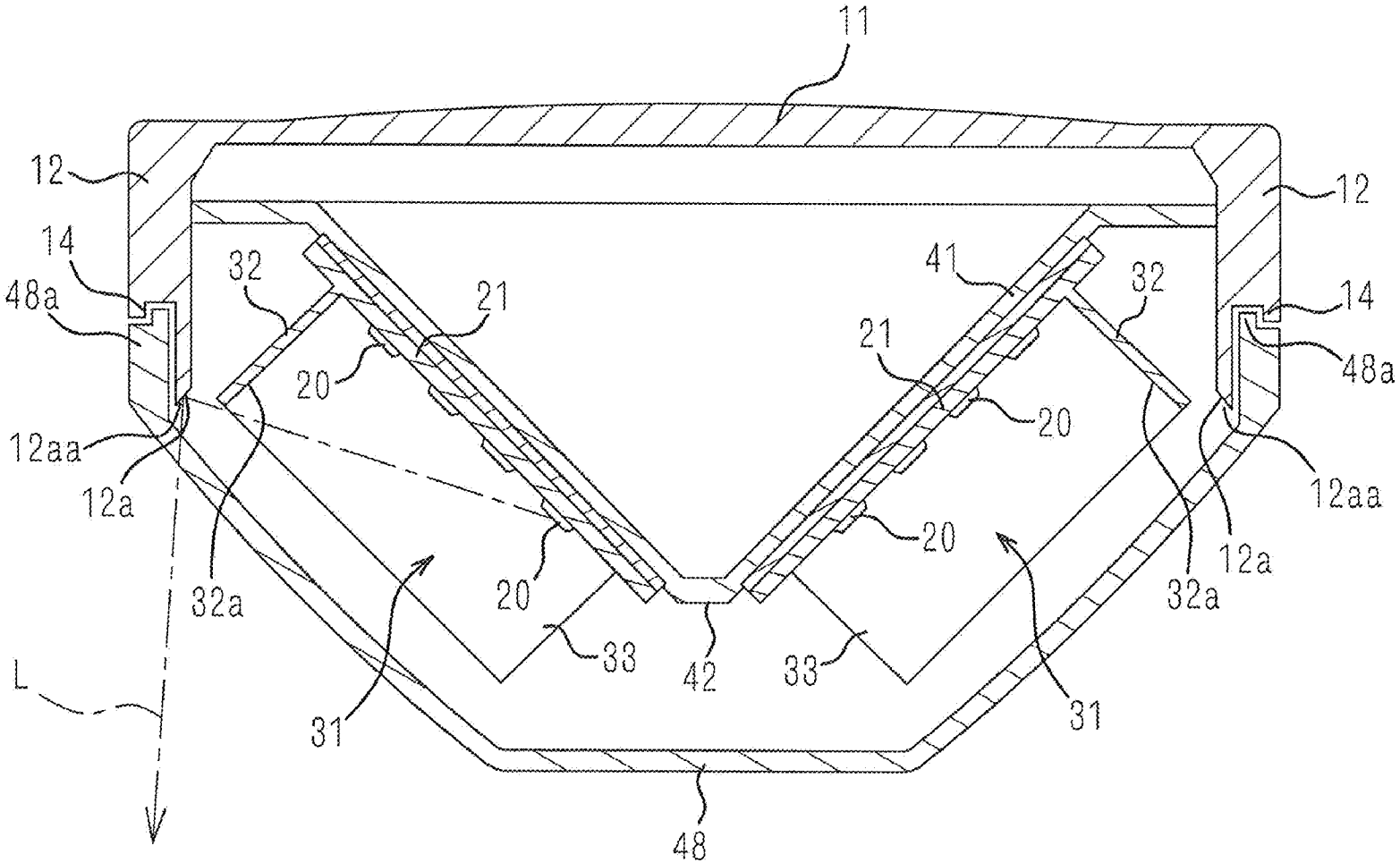
FIG. 5(*a*) is a cross-sectional view in a side direction showing a second embodiment of the illumination device according to the present invention.
Figure 5:
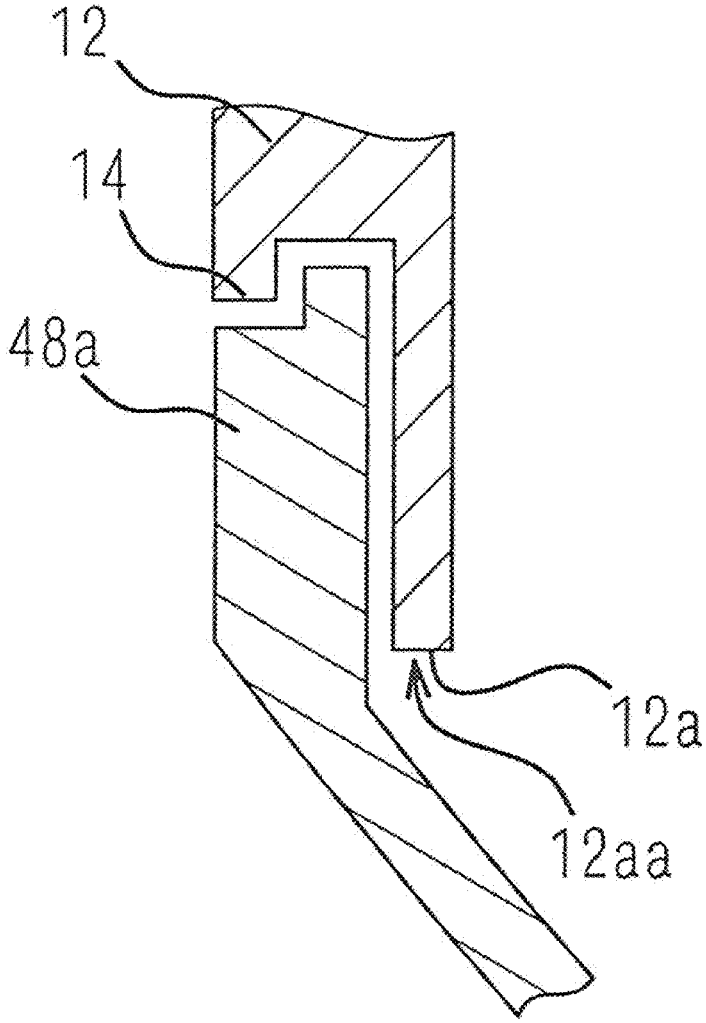

FIG. 5 illustrates an illumination device according to a second embodiment and shows a cross-sectional view in a plane parallel to the end surface. In this illumination device of FIG. 5, a reflection surface 12*aa* is formed for reflecting the light emitted from the LED 20 of the light source in the light source part 40 in a lower direction than the approximately horizontal direction. This reflection surface 12*aa* is formed so as to have a mirror surface, for example. Then, in order to reflect the light emitted from the LED 20 in a lower direction than the approximately horizontal direction, the reflection surface 12*aa* is formed as a slanted surface facing the internal direction of the device main body 10 as shown in FIG. 5(*a*), or formed as a horizontal surface facing downward as shown in the enlarged view of FIG. 5(*b*). In a case in which the reflection surface 12*aa* is the slanted surface facing the internal direction of the device main body 10, there is required a caution against that the light is reflected in the upper direction even within the inside of the device main body 10 when the top angle of the lower end edge part 12*a* is sharper than a predetermined angle.

The second embodiment employs the same configuration as that of the first embodiment for the other configuration such as one in which the lower end edge part 12*a* of the side wall part 12 in the device main body 10 is formed at a height approximately the same as that of the above top end 32*a* of the second reflection surface 32, The illumination device configured in this manner reflects the light emitted from the LED 20 in a lower direction than the approximately horizontal direction by the reflection surface 12*aa* as shown in FIG. 5(*a*), and the reflected light substantially becomes illumination light directed downward toward the side of a plane to be illuminated resulting in an efficient use of the light.

REFERENCE SIGNS LIST

10 Device main body
11 Top plate
12 Side wall part
13 End plate part
30 Reflector
32 Second reflection surface
33 First reflection surface
40 Light source part
50 Lighting device

What is claimed is:

1. An illumination device comprising:

a light source part including a light source and a reflector, the reflector including a first reflection surface which has a concavely curved cross section from a first end to a second end and a second reflection surface closing the curved cross section on the first end side, the light source being disposed within the concavely curved cross section; and a device main body including a top panel, the top panel having a lower surface side, an attachment part which is provided on the lower surface side of the top panel and attaches to the light source part so as to position one end of the light source part closer to the top panel than another end of the light source part, and a side wall part which is disposed downward from the top panel and has a lower end edge part provided below a straight line extending from the light source positioned on the other end of the light source part through a top end of the second reflection surface wherein the attachment part includes a bent panel having a V-shaped cross section, and the light source part is disposed on a lower surface side of the bent panel.

2. The illumination device according to claim 1, wherein the lower end edge part of the side wall part is disposed above a height approximately the same as that of a top end of the second a reflection surface.

3. The illumination device according to claim 1 or 2, wherein a third reflection surface is formed at the lower end edge part of the side wall part, the third reflection surface being configured to reflect light emitted from the light source of the light source part in a lower direction than an approximately horizontal direction.

4. The illumination device according to claim 1 or 2, wherein the light source part is attached to the top panel at a slant so that the first reflection surface faces downward and the device main body includes an end plate part provided on the lower surface side of the top panel and includes a lower end edge part disposed below a height approximately the same as that of a highest end of a side edge part of the second end of the first reflection surface.

5. The illumination device according to claim 4, wherein the lower end edge part of the end plate part is disposed above a height approximately the same as that of a lowest end of the side edge part of the other end of the first reflection surface.

* * * * *